US005572847A

United States Patent [19]

Elmore et al.

[11] Patent Number: 5,572,847

[45] **Date of Patent: *Nov. 12, 1996**

[54] RAPIDLY ERECTABLE, REMOVABLE, REUSABLE AND RAISABLE OUTDOOR ACOUSTICAL WALL SYSTEM

[75] Inventors: J. Thomas Elmore; Alan Veatch, both of Washington, D.C.; William C. Clements, Reston, Va.

[73] Assignee: JTE, Inc., Lorton, Va.

[ * ] Notice: The term of this patent shall not extend beyond the expiration date of Pat. No. 5,274,971.

[21] Appl. No.: 392,476

[22] Filed: Feb. 22, 1995

Related U.S. Application Data

[63] Continuation-in-part of Ser. No. 176,953, Jan. 3, 1994, Pat. No. 5,392,572, which is a continuation of Ser. No. 935,895, Aug. 28, 1992, Pat. No. 5,274,971.

[51] Int. Cl.[6] ..... E04B 1/61

[52] U.S. Cl. ..... 52/766; 52/144; 52/780; 181/284; 181/287

[58] Field of Search ..... 52/144, 275, 277, 52/766, 775, 780, 781, 169.2, 169.4; 181/210, 284, 287

[56] References Cited

PUBLICATIONS

Blueprints and sketches dated Jan. 2, 1992 by the Reinforced Earth Company illustrating use of wedge blocks with panels.

*Primary Examiner*—Carl D. Friedman
*Assistant Examiner*—Creighton Smith
*Attorney, Agent, or Firm*—Sixbey Friedman Leedom & Ferguson; Daniel W. Sixbey; Thomas W. Cole

[57] ABSTRACT

A rapidly erectable, removable, reusable, and raisable acoustical wall system is provided that comprises a plurality of wall panels, each of which has opposing side edges which include a front edge and a back edge, a plurality of panel support posts having pairs of parallel flanges for receiving the side edges of the wall panels to form a wall, and a plurality of wedging members for forcefully securing the front side edges of the panels into an acoustically-obstructing engagement with the front flanges of the panel support posts. Wedge-receiving recesses are provided at the top and bottom of each of the back side edges of the panels, the top recesses of one panel being registrable with the bottom recesses of another panel when two panels are stacked between the same support posts. Each wedging member is about the shine length as two aligned wedge-receiving recesses so that a single wedging member may be used to forcefully engage the front side edges of two different panels against the front flanges of their respective support posts. In the apparatus of the invention, the erection of the walls is expedited by the wedging members, which function to forcefully engage the bottom half of a wall panel into acoustically-obstructing engagement with its respective support post simply by the act of stacking one wall panel over another. Additionally, the resulting wall may be easily raised at another location by mounting extension members on the tops of the support posts, and sliding additional wall panels between the heightened posts.

30 Claims, 13 Drawing Sheets

RAPIDLY ERECTABLE, REMOVABLE, REUSABLE AND RAISABLE OUTDOOR ACOUSTICAL WALL SYSTEM

This is a continuation-in-part of U.S. patent application Ser. No. 08/176,953 filed Jan. 3, 1994, and now issued as U.S. Pat. No. 5,392,572, which in turn is a continuation of U.S. patent application Ser. No. 07/935,895, filed Aug. 28, 1992, now issued as U.S. Pat. No. 5,274,971.

BACKGROUND OF THE INVENTION

This invention is generally concerned with wall erection systems and methods, and is specifically concerned with a rapidly erectable, removable, reusable and raisable post and panel-type acoustical wall system.

Acoustical wall systems for obstructing highway noises from residential areas are known in the prior art. Such wall systems generally take three different forms, including self-supporting walls, monolithic post and panel precast walls, and separate steel/concrete or wood post and panel precast walls. When viewed from above, self-supporting wall systems have an undulating profile which resembles a square or trapezoidal wave function which makes them self-supporting without the need for deep underground foundations. They are used where a flat and wide right-of-way is available on either side of the noise-generating highway, and where the ground provides good foundational support. Unfortunately, the larger amount of panel surface caused by the square or trapezoidal-wave profile of these walls necessitates 10% to 30% more structural and sound obstructive materials for their construction, which in turn causes them to be relatively expensive. Additionally, self-supporting wall systems are not compatible with certain desirable architectural wall finishes, and are difficult to install in terrain having significant relief. While self-supporting walls can be removed and reused, such removal and reuse is labor and equipment intensive. Finally, because of the section required to develop the weight required to be self-supporting, the economical height to which the wall can be raised is limited.

Monolithic precast wall systems employ single-monolithic panels supported by concrete support columns integrally cast into the side edges of the panels. They are erected by tongue and groove connections between adjacent panels, and connections between the bases of the columns and a structural foundation is normally welded or bolted. While monolithic precast walls advantageously employ fewer amounts of wall panel materials than self-supporting walls, they are permanent structures which would be removable only with great difficulty with the help of large equipment requiring large amounts of working space. Additionally, these walls are not raisable or otherwise height-adjustable. Moreover, because the alignment of the joints between adjacent panels is dependent upon the grade of the specific terrain that the wall is initially erected on, it is difficult to re-use the same panels in a location having a different grade.

Post and panel acoustical wails employ panels that are slidably mounted between and supported by structurally independent support posts. The support posts are typically steel or concrete columns having opposing pairs of flanges which slidably receive the side edges of wall panels upon the raising of a panel by a crane above two adjacent support posts, and the subsequent lowering of the panel between the posts after the side edges are aligned between the flange pairs. Either a single panel or a stack of panels may be mounted between two adjacent posts. While post and panel walls have certain installation advantages over monolithic precast walls, they also have their disadvantages. One major disadvantage stems from the necessity of having to leave some amount of slack in the distance between the flanges of the support posts and the thickness of the side edges so that the panels may be quickly aligned between the flanges of the beams prior to slidably lowering them between two flange pairs of adjacent posts. As a result of this slack, the front side edges of the panels cannot snugly engage the front flanges of their respective support posts, which if not corrected will create substantial acoustical leaks in the resulting wall, and poor structural alignment of the panels.

In the past, this slack has been eliminated by the installation of steel angle members between the back flanges of the support posts and the back side edges of the panels to take up the unwanted slack in combination with the application of caulking between the panels and the posts. However, the installation of such steel angles has proven to be an expensive and time consuming step in the assembly of such wall systems, as it requires the drilling of a specific pattern of holes through the flanges of the I-beams forming the support posts, the regalvanization of the I-beams, as well as the tedious installation of several nuts and bolts for every angle in such a way that they continuously apply pressure to the back side edges of the panel. The materials cost is also substantial, not only with respect to the steel angles themselves, but the nuts and bolts necessary to mount them as well. Moreover, the use of such steel angle members sometimes fails to permanently remove unwanted slack between the front side edges of the panels and the flanges of the posts because of the constant vibration that such wall systems are subjected to due to their proximity to a heavy flow of road traffic. Vandals have occasionally been known to remove the nuts and bolts that secure the angle members in their place, which of course necessitates their replacement with its attendant expenses. Both the caulking of the panels and the posts and the installation of the numerous nuts and bolts used to mount the angle members substantially slows down both the raising and the disassembly of the wall system (should removal of the wall become desirable). Additionally, the custom pattern of bolt holes that must be drilled or molded in the flanges of each of the I-beams forming the posts makes it difficult, if not impossible, to reuse the same post structures should it become desirable to rebuild the wall system at a different location. The raising would require substantial reengineering of the post which has holes punched in the structural flanges.

Clearly, there is a need for an improved post and panel type acoustical wall system which overcomes all of the aforementioned disadvantages associated with the angle members used in prior art wall systems, and which provides an alternate means for removing unwanted slack between the back side edges of the panels and the flanges of the posts which does not impede the raising, disassembly or removability of the wall system. Ideally, such an alternative slack-removing means would not necessitate the drilling of a custom pattern of holes in the I-beams forming the posts so that the posts could be easily reused to build another wall system should it ever become desirable to remove or relocate the original wall system. The slack removing means should also be durable, inexpensive, versatile, and not easily prone to destruction by either weather conditions or vandalism. The resulting wall systems should also be rapidly erectable, removable, easily reusable, and raisable beyond the height of the originally-used posts to accommodate changes in the acoustical conditions surrounding the highway (which might occur, for example, if the highway were widened).

SUMMARY OF THE INVENTION

Generally speaking, the invention is a rapidly erectable, removable, reusable, and raisable post and panel-type acoustical wall system which overcomes all the aforementioned disadvantages by the use of wedging members which wedgingly and removably secure the side edges of the wall panels into acoustically obstructing engagement with the panel support posts. In the preferred embodiment, the wall panels are precast panels formed from a moldable material such as concrete, and each of the panels may include a front face over which a layer of acoustically obstructive material is placed. For a sound reflective wall system, this layer may simply be a finished concrete face. For a sound absorptive wall system, this layer may be a commercially available sound absorbing medium such as Durisol or Soundtrap/Soundlock. The wall panels may also be panel assemblies formed from a plurality of plank-like panel members extruded from a polymeric material that interfit with one another by tongue and groove joints. Each of the side edges of the wall panels may include a planar front edge and a back edge, and the panel support posts are preferably formed from galvanized steel I-beams having two pairs of parallel flanges extending from a centrally disposed web. Each of the pairs of parallel flanges receives one of the side edges of the wall panels, and wedging members are inserted between the back side edges of the panels and the back flange of the beam forming the support post in order to snugly secure the planar from edges of each of the panels into acoustically obstructing engagement with the front flange of the beam.

The upper and lower ends of each of the back side edges of the panels includes a means for retaining one of the wedging members. In the case of precast panels, such a retaining means preferably takes the form of a recess that is complementary in shape to the wedging member. In the case of panel assemblies formed from a plurality of interfitting plank-like members, the retaining means may take the form of the recesses that are inherently present around the tongue and groove joints that join the panel members. In either case, these wedge-receiving recesses are positioned on the top and bottom ends of each of the back side edges such that they interconnect when one wall panel is slidably stacked over another wall panel between the same two I-beams, which advantageously allows a single wedging member to simultaneously force the front side edges of two different wall panels into acoustically obstructing engagement with the front flanges of the I-beams.

Preferably, the wedging members are formed from wood having compressive properties commensurate with the compressiveness of the sound-obstructing layer of material applied over the front faces of the wall panels. For example, if the from faces of the panels are covered with a relatively soft and compressible sound-absorbing material such Durisol, the wedging members are preferably formed from a relatively soft wood such as pine, which is capable of partially yielding when forced in the recess of the wall panel between the back side edge and the back flange of the I-beam. Such properties will apply a continuous pressure on the Durisol which will effectively seal out sound without crushing the sound-absorbing material. On the other hand, when the front face is merely finished concrete as would be the case with a sound reflective wall, a harder wedging member formed from oak or other hard wood may be used. All wooden wedging members are preferably pressure-treated to resist decay and insect attack. Alternatively, wood-polymer composites or plastic elastomers of varying hardness may be used to form the wedging member. Finally, a wedging assembly may be used whose width is adjustable to accommodate different amounts of slack spaces between the flanges of the post and the thickness of the wall panels. Such a wedge assembly may include a wedging member that may be interconnected with any one of a number of different sized width extender members.

In the operation of the invention, a plurality of vertical-oriented support posts in the form of I-beams or precast columns are erected, these beams being spaced apart approximately the same distance as the width of the wall panels. Next, half-size wedging members are placed at the bottom of the beams between the two opposing flanges thereof. A wall panel as heretofore described is then lifted above the ends of two adjacent I-beams, and the side edges are slidably inserted between the opposing pairs of flanges of each of the beams. Wedge-retaining recesses located on the bottom of the panel are aligned with and lowered over the half-size wedging members. After the panel lowering operation is completed for this first panel, a pair of full-size wedging members is forcefully inserted into the wedge retaining recesses located at the top ends of each of the back side edges of the panel. The lowering operation and insertion operation wedgingly presses the front side edges of the wall panel into acoustically obstructing engagement with the front flanges of the two adjacent I-beams supporting it. As the length of each full-size wedging member is approximately twice the length of the recess in which it is inserted, the top ends of the two wedging members protrude upwardly above the top edge of the lowered panel. A second wall panel is then raised above the upper ends of the two adjacent I-beams, and lowered over the top edge of the bottommost wall panel. Because the topmost wall panel has wedge-receiving recesses on the bottom ends of its two back side edges which register with the recesses of the bottommost panel when the two are stacked together between the two support beams, the upper ends of the wedging members already present in the recesses of the lower panel become forcefully inserted in the lower recesses of the topmost panel due to the weight of the topmost panel as it is being lowered. This mechanical action automatically causes the front face of the topmost panel to be forced into the front flanges of the two supporting I-beams in acoustically obstructing engagement. The two mutually registering recesses, in combination with the overlying back flange of the I-beams, positively capture the wedging member in such a manner that it will not fall out when the resulting wall is rattled from highway sound or wind, and affords so little access to the wedging member that it is impossible for vandals to remove them from an assembled wall.

To complete the assembly of the wall, the panel stacking and wedging member insertion operations are repeated until the wall is raised to a desired level.

To remove the resulting wall structure, all that is necessary to do is to reverse the assembly steps, i.e., remove the topmost wedging members located on the top side edges of the topmost wall panel, slidably remove the topmost wall panel from between the two adjacent I-beams by means of a crane, and then repeat the same steps until all of the panels and wedging members are removed. Preferably, I-beams that form the support post of the system are bolted onto pedestals by means of studs so that they can be conveniently removed and used in conjunction with the same wall panels and wedging members to rebuild the wall at a different location.

Because the use of the wedging members obviates the need to drill customized patterns of holes in the beams, beams from disassembled walls may be easily reused and even spliced together to raise the height of the reassembled wall.

BRIEF DESCRIPTION OF THE SEVERAL FIGURES

Figure 7:
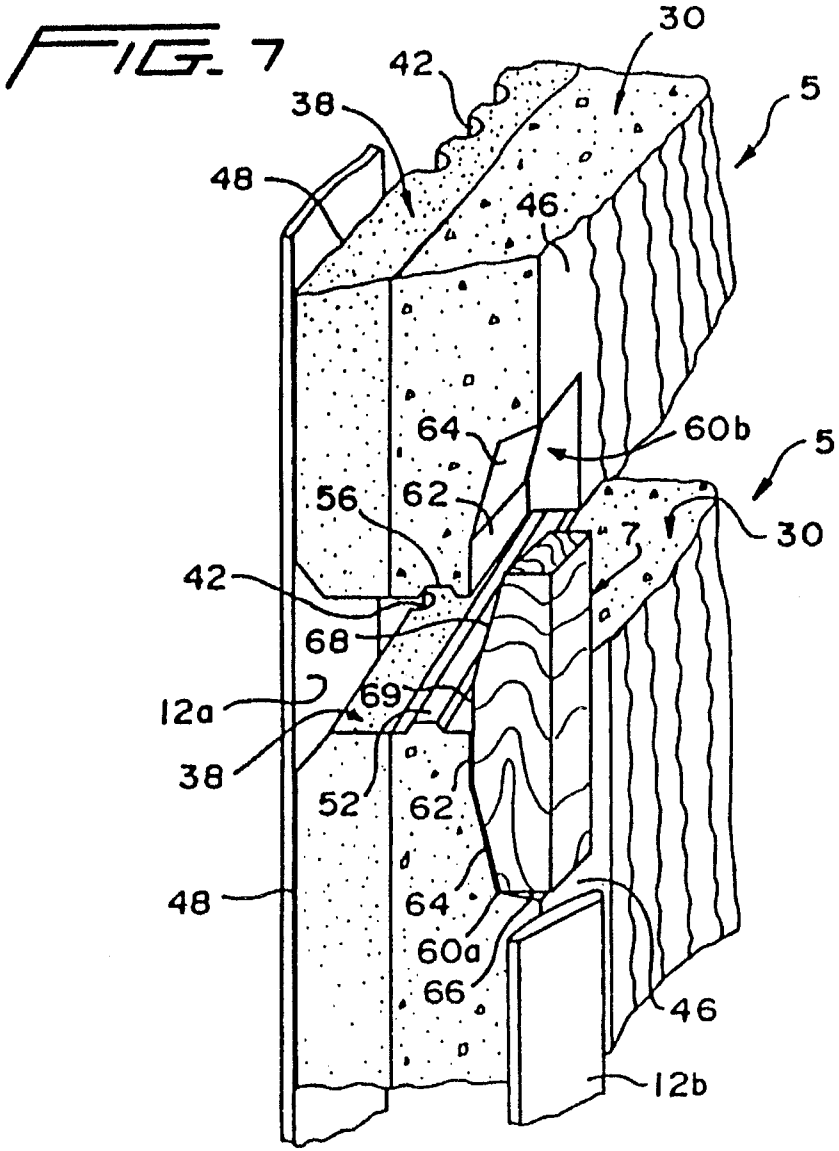
Figure 6:
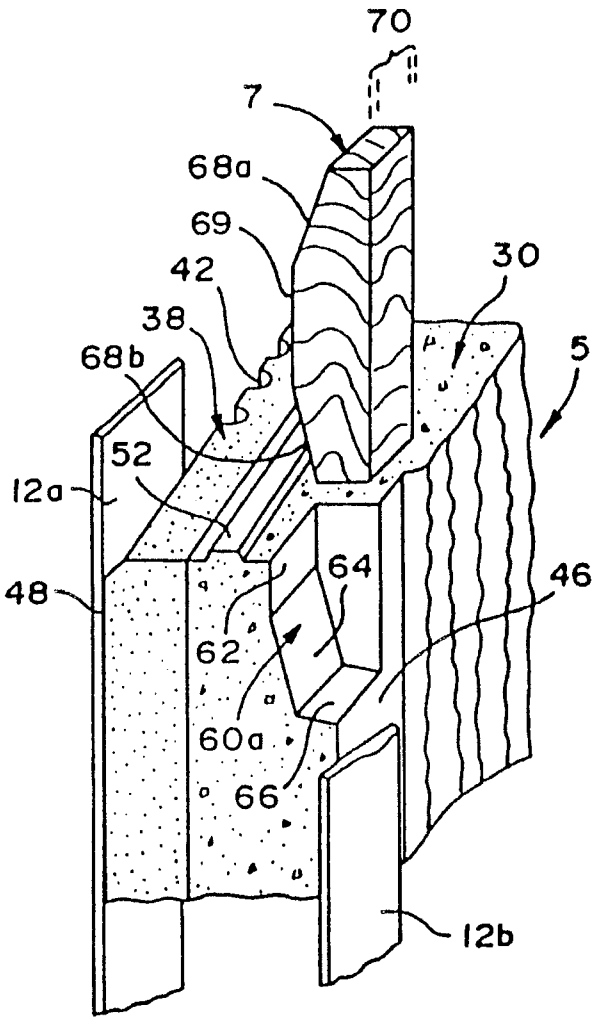
Figure 8:
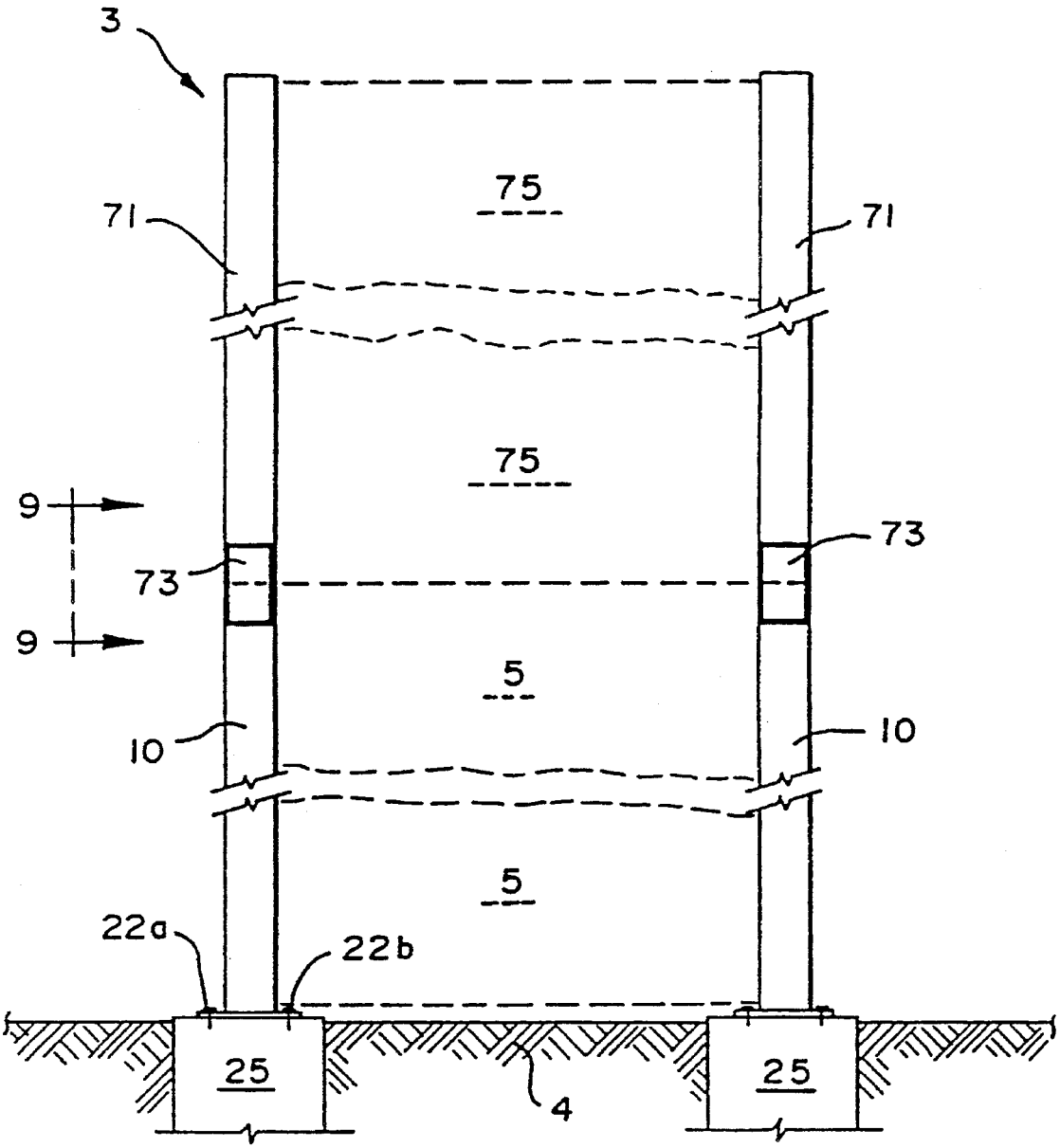
Figure 9:
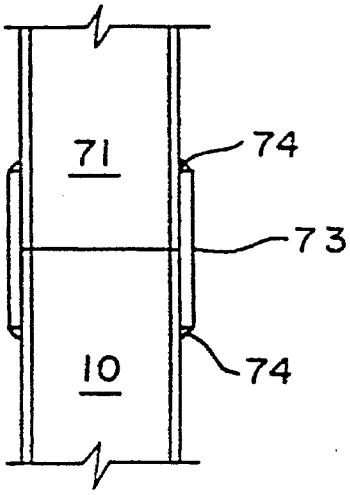
Figures 10, 11, 12:
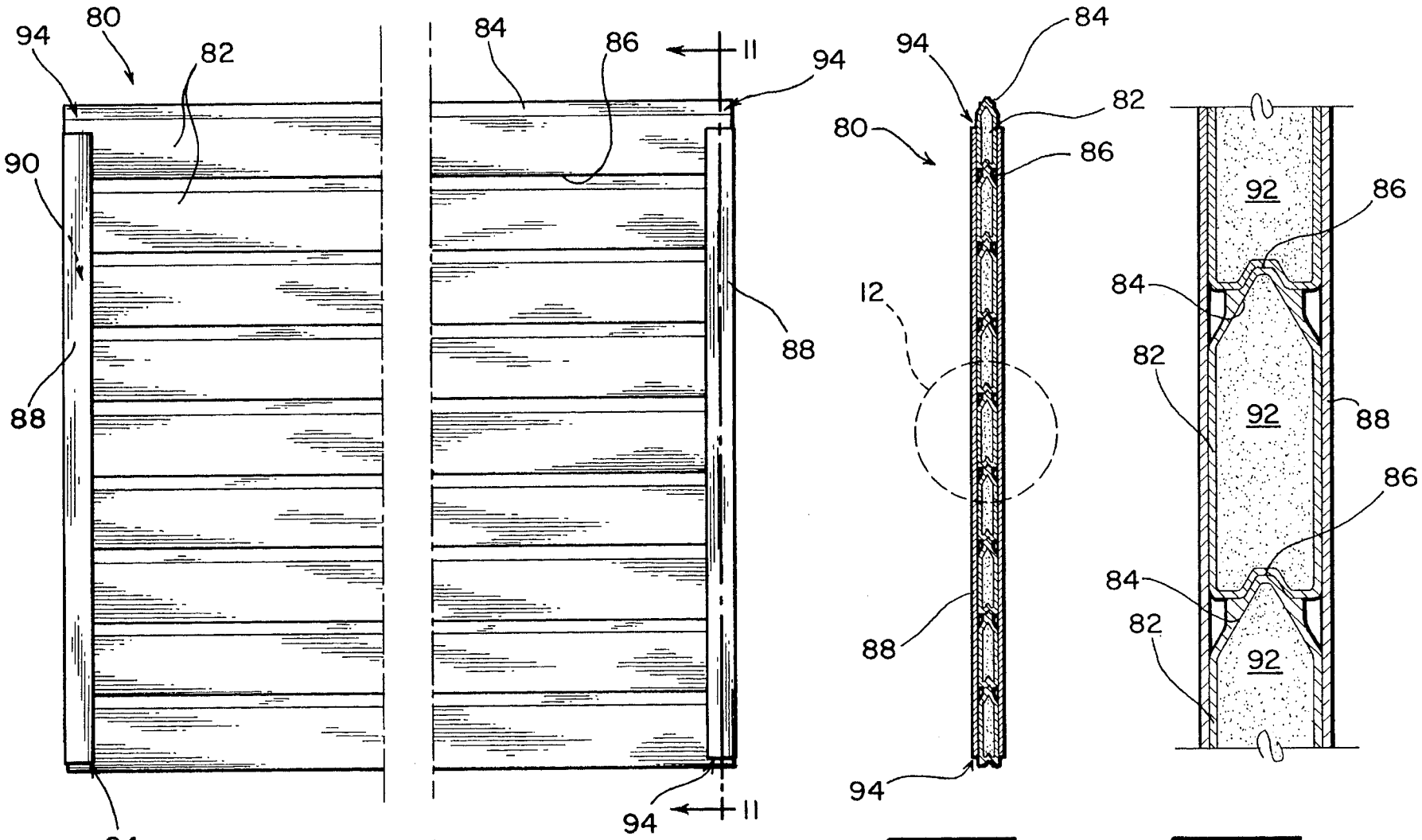
Figure 15:
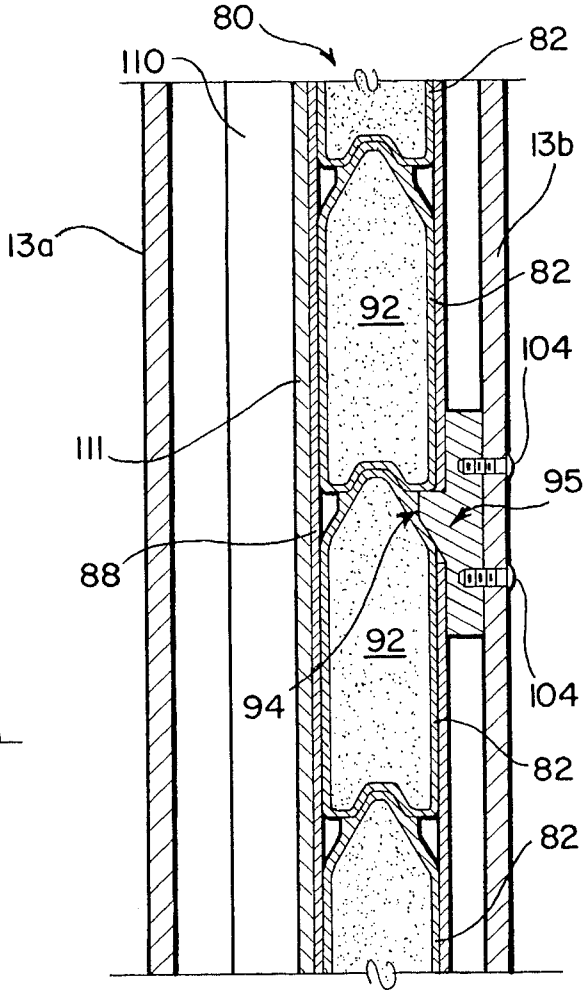
Figure 14:
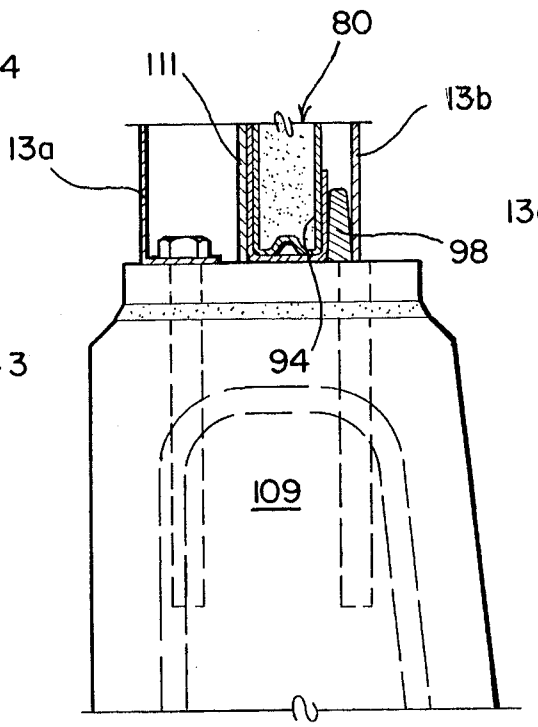
Figure 13:
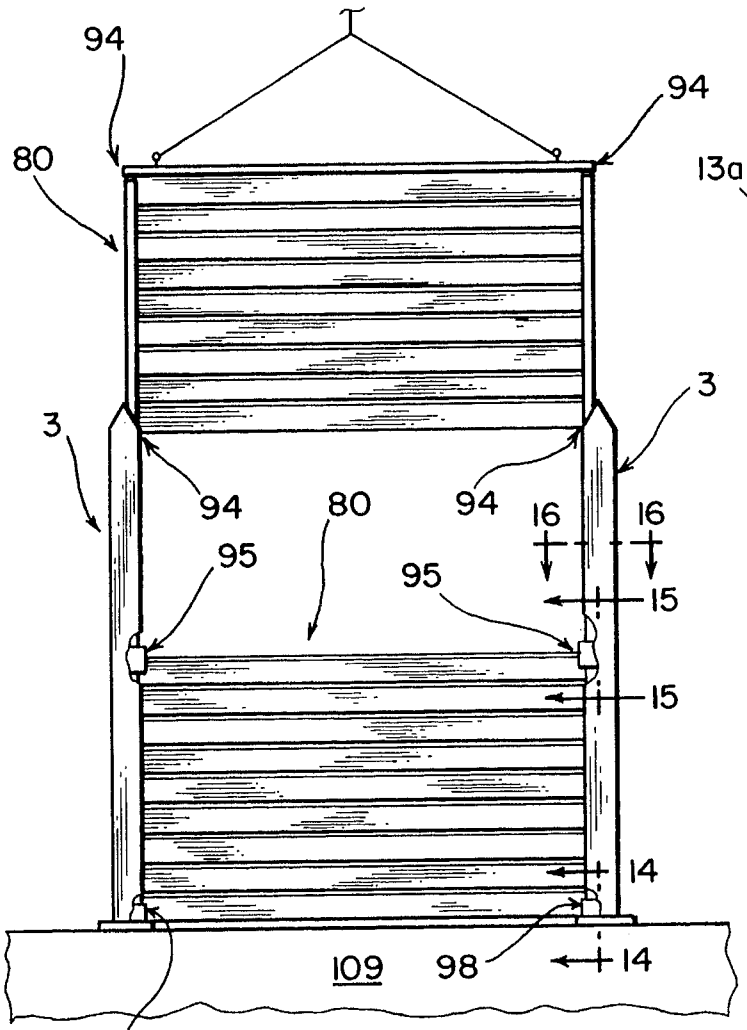
Figure 18:
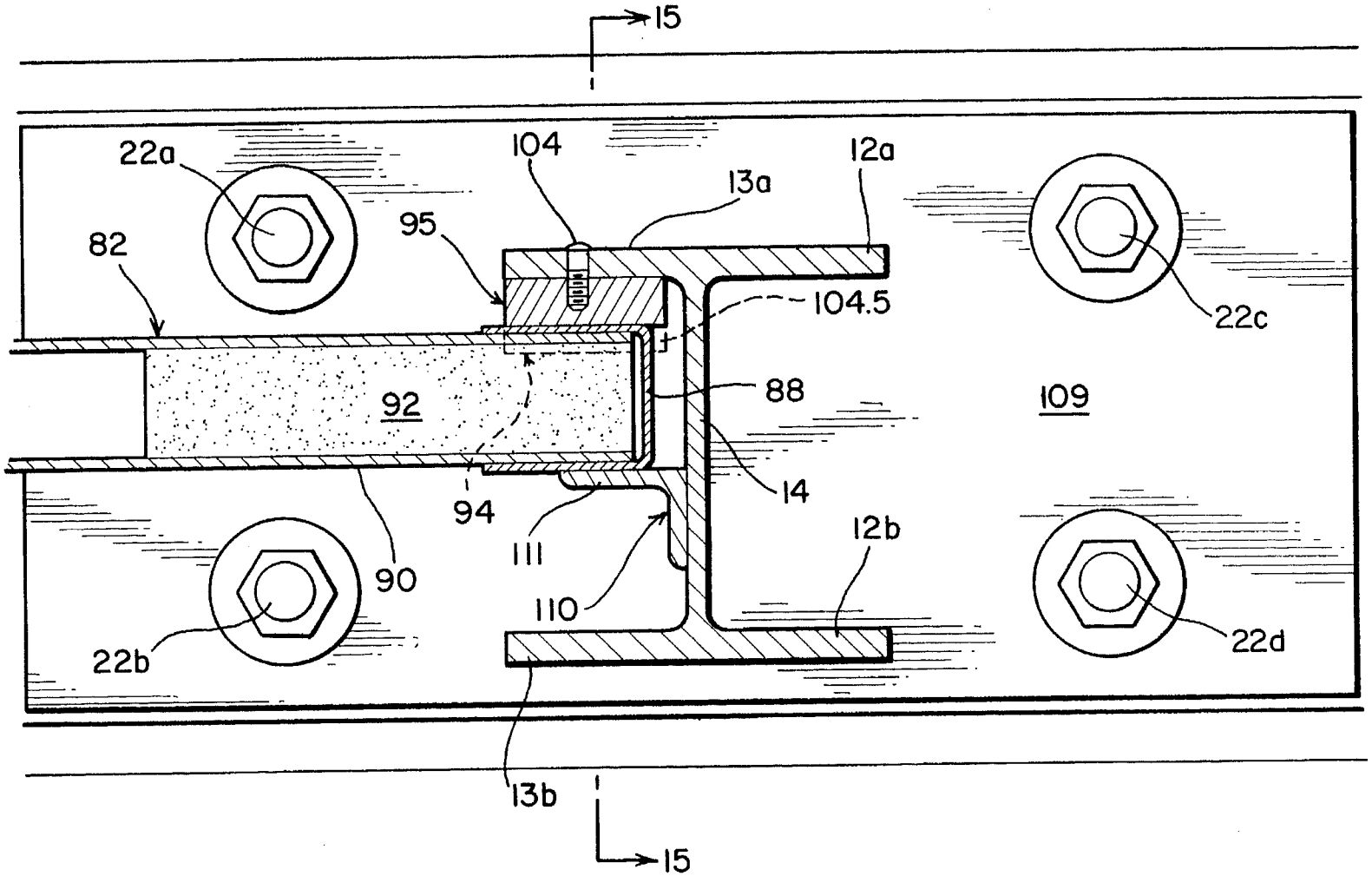
Figure 17C:
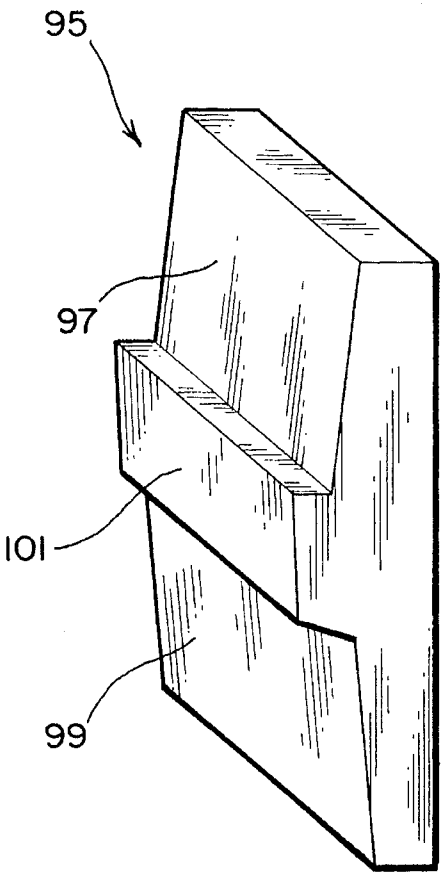
Figure 17B:
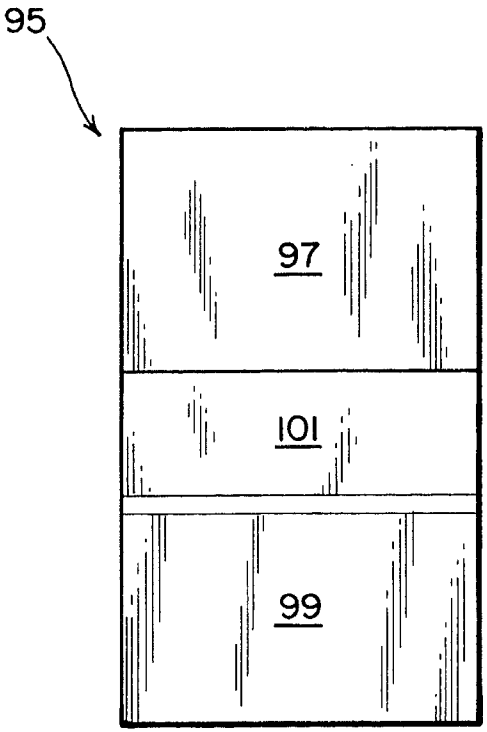
Figure 17A:
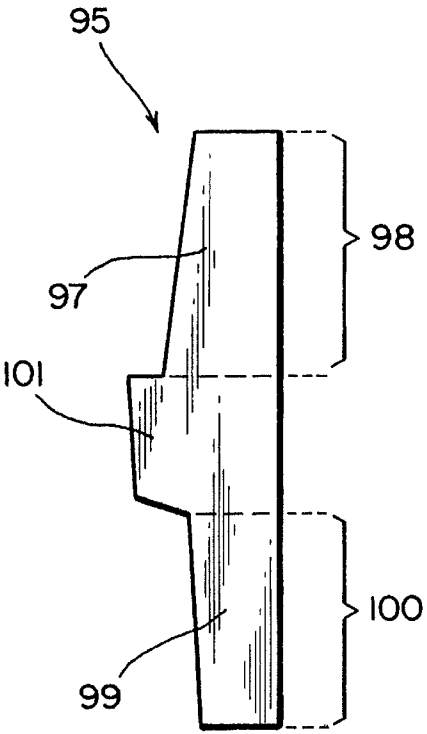
Figure 19:
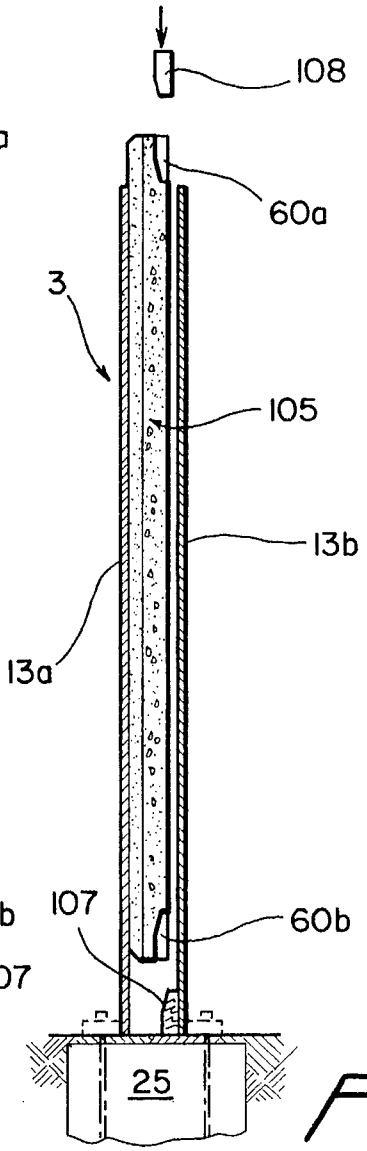
Figure 18:
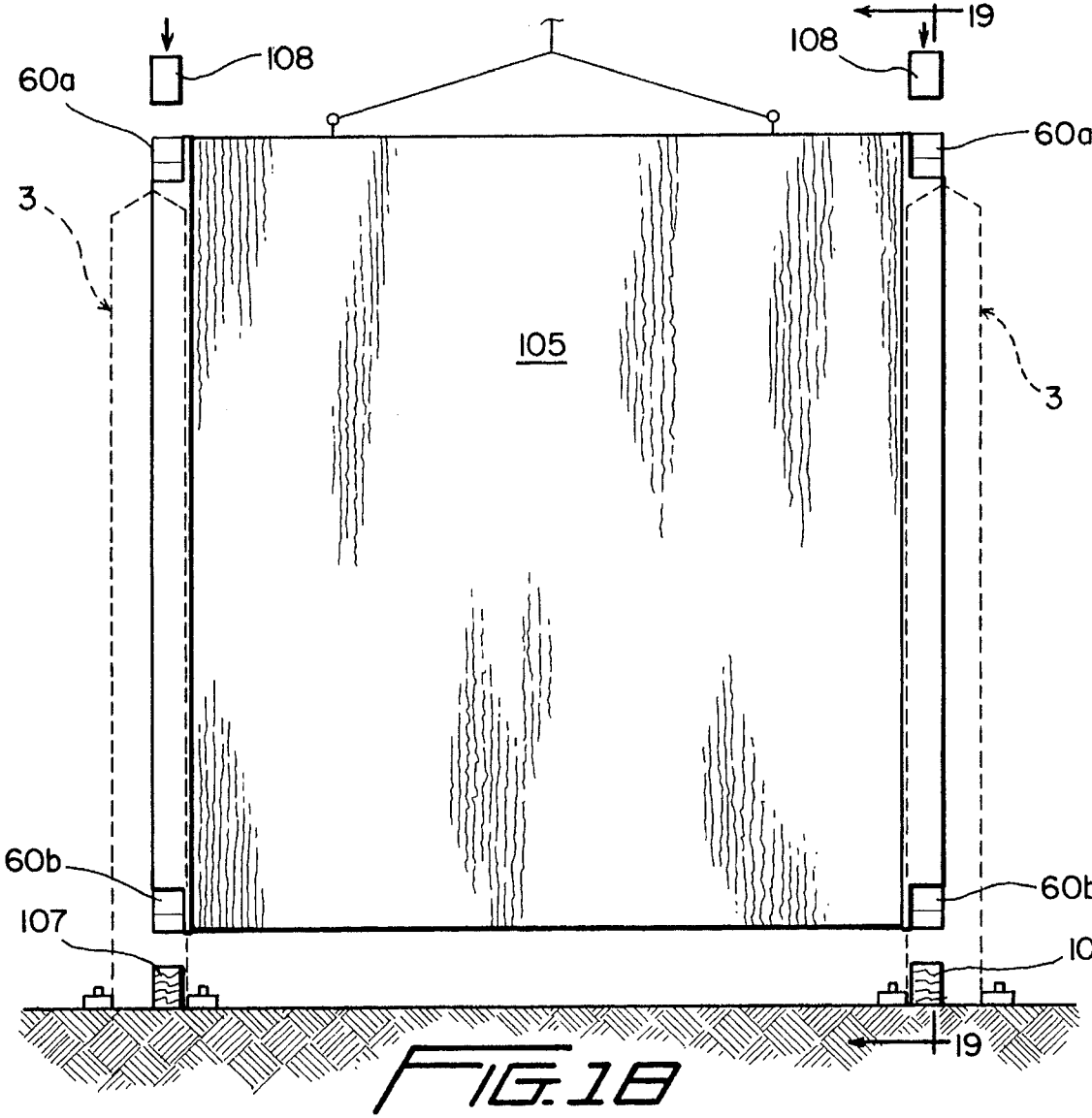
Figure 21:
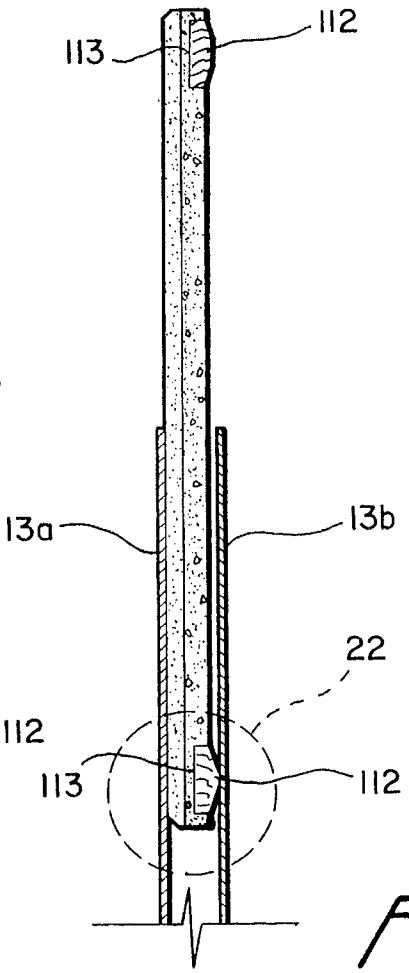
Figure 20:
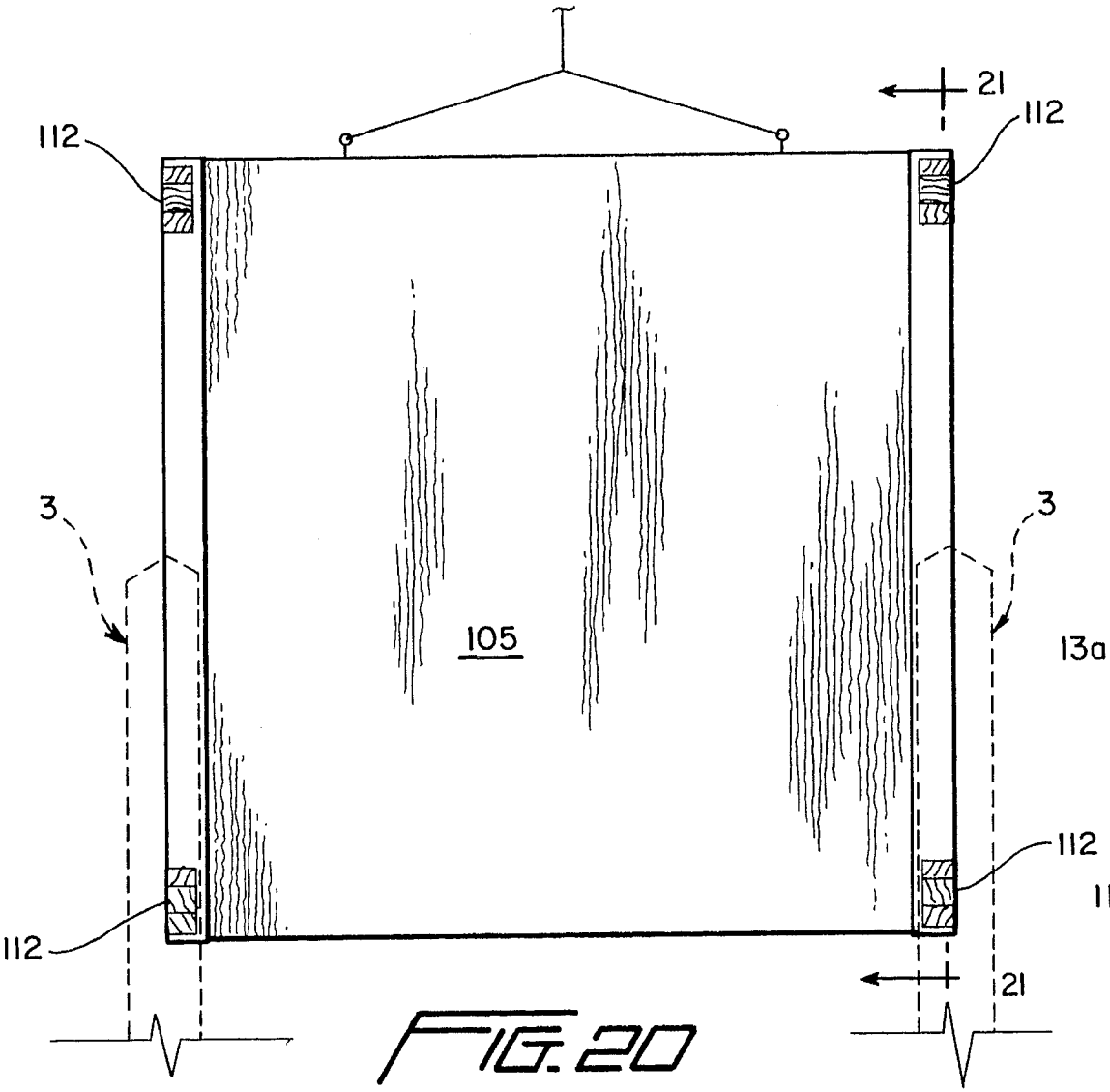
Figure 22:
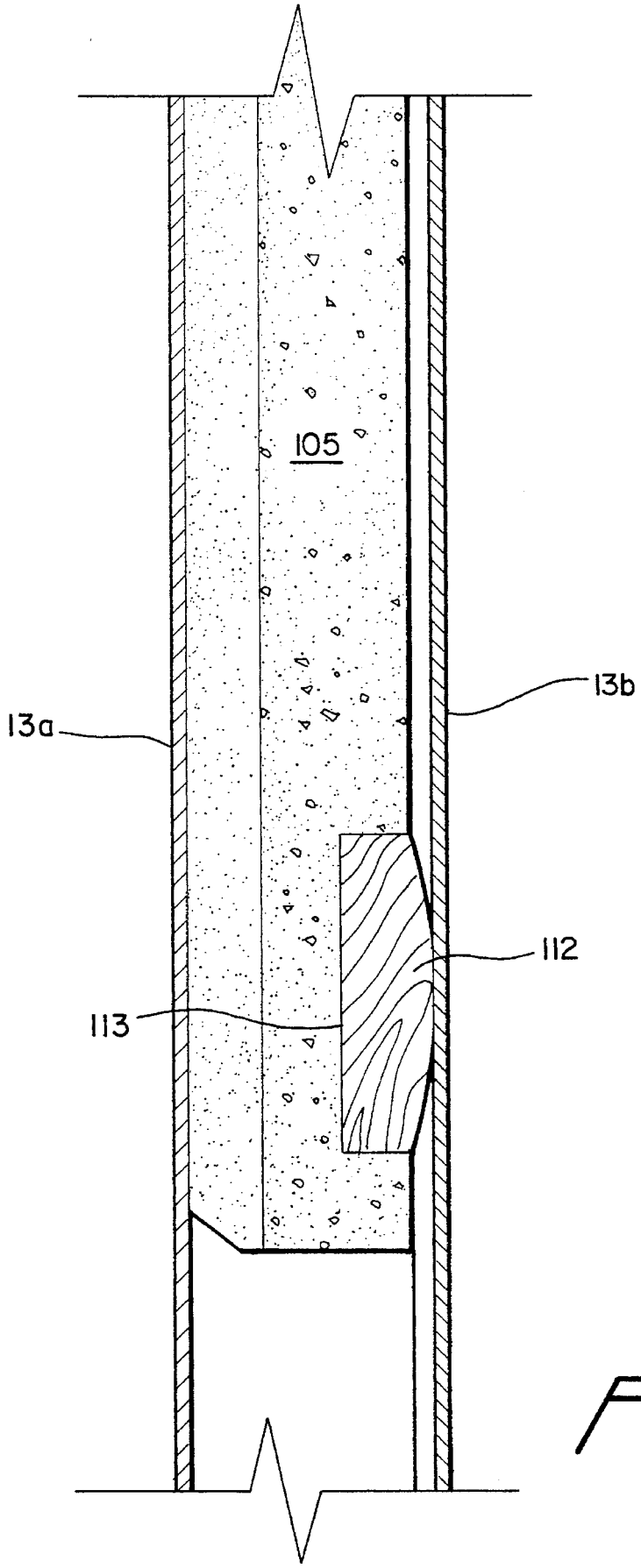
Figure 24:
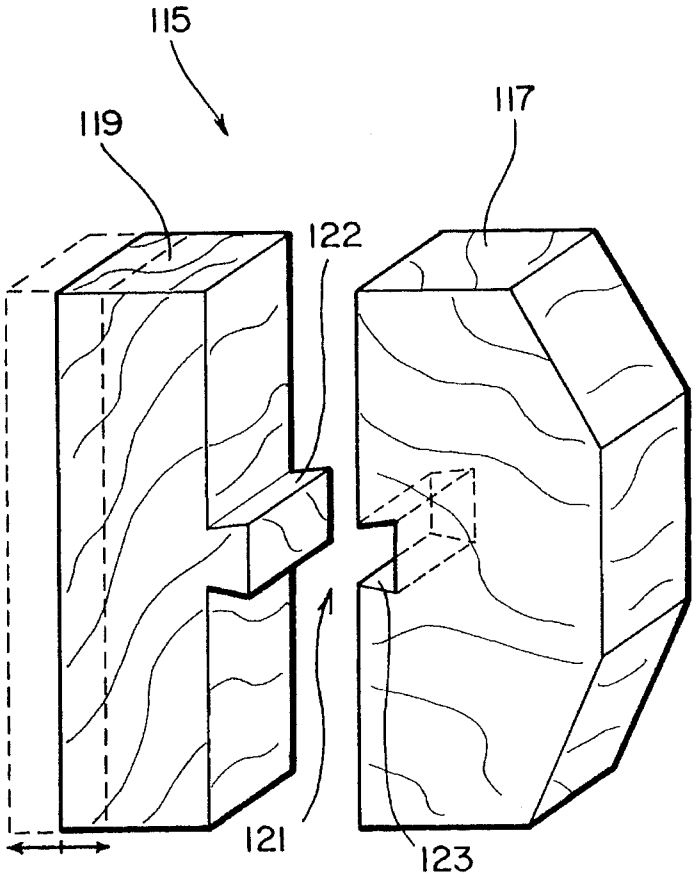
Figure 23:
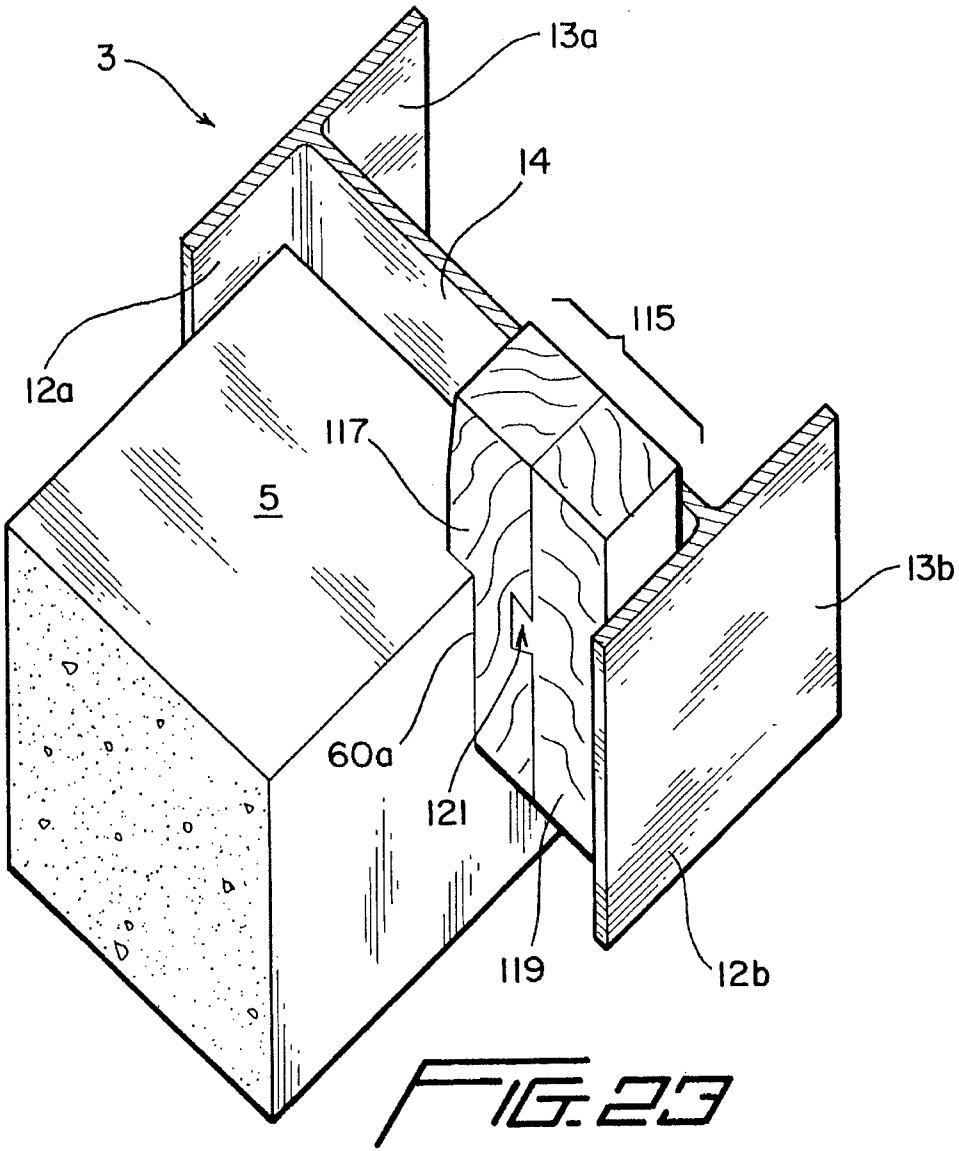

FIG. 6 is a perspective side view of one of the panels of the system, illustrating how the wedging member may be inserted into a complementarily shaped wedge-receiving recess in order to snug the front side edge of the panel into acoustically obstructing engagement with the front flange of one of the posts, and FIG. 7 is a side perspective view of one panel being lowered in stacked relationship on top of another panel, illustrating how the protruding top end of the wedging member will automatically be received within the recess of the topmost panel in order to force its front side edges into engagement with the front flanges of the posts merely by lowering the upper panel on top of the lower panel;

FIG. 8 is a side view of the wall system of the invention, illustrating how the posts may be extended in order to raise the height of a reassembled wall;

FIG. 9 is a side view of one of the posts illustrated in FIG. 8 along the line 9—9, illustrating how extensions to the posts may be spliced on, FIG. 10 is a front view of a sound-reflective panel assembly which may be used in the wall system of the invention;

FIG. 11 is a side view of the panel assembly illustrated in FIG. 10 along the line 11—11;

FIG. 12 is an enlargement of the area surrounded by the dotted circle in FIG. 11, illustrating how the panel members forming the panel assembly interfit in tongue-and-groove fashion;

FIG. 13 is a front view of an alternate embodiment of the wall system that uses the sound reflective panel assemblies of FIGS. 10 through 12, illustrating one panel assembly being lowered in stacked relationship on top of another panel assembly between two posts mounted on a concrete parapet or traffic barrier, illustrating how half-wedging members are placed at the bottom of the post and full-sized wedging members are placed between the panel assemblies in order to wedgingly press the panel assemblies into engagement with the front flange of the posts;

FIG. 14 is an enlarged side view of FIG. 13 along the line 14—14 illustrating how a half-wedging member presses the bottom of the lower panel assembly against a flange;

FIG. 15 is an enlarged side view of the wall system illustrated in FIG. 13 along the line 15—15 after the upper panel assembly has been stacked on top of the lower panel assembly illustrating how a full-size wedging member engages both the upper and lower panel assembly;

FIG. 16 is a plan view of the wall system illustrated in FIG. 13 along the line 16—16;

FIG. 17A, 17B, and 17C are side, front, and perspective views of the full-size wedging member used to apply wedging forces in the embodiment of the wall system illustrated in FIG. 13;

FIG. 18 is a back view still another embodiment of the wall system that utilizes single, unstacked panels to form the acoustical wall;

FIG. 19 is a side view of the embodiment of the wall system illustrated in FIG. 18 along the line 19—19;

FIG. 20 is a back view of a further embodiment of the wall system wherein a single panel is used in combination with reversed wedging members;

FIG. 21 is a side view of the embodiment of the wall system illustrated in FIG. 20 along the line 21—21;

FIG. 22 is an enlargement of the portion of FIG. 21 enclosed by the dotted circle;

FIG. 23 is a perspective view of the width-adjustable wedging assembly of the invention being used to press the top portion of a concrete panel against the front flange of a post, and FIG. 24 is an exploded, perspective view of the wedging assembly of FIG. 23, illustrating how its two components are interconnected by means of a dovetail joint.

DETAILED DESCRIPTION OF THE PREFERRED EMBODIMENT

Figure 1A:
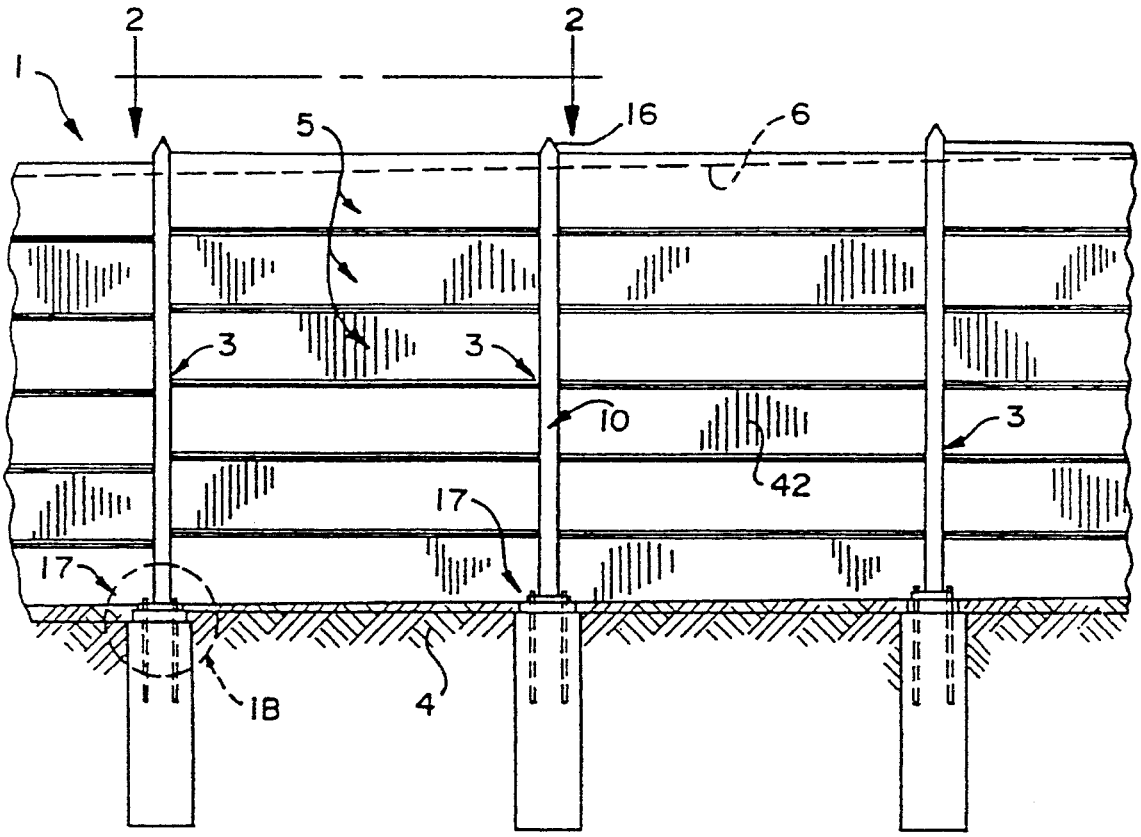
FIG. 1A is a side view of the acoustical wall system of the invention as it appears assembled into a wall, with the base assemblies of the post shown uncovered.
Figure 2:
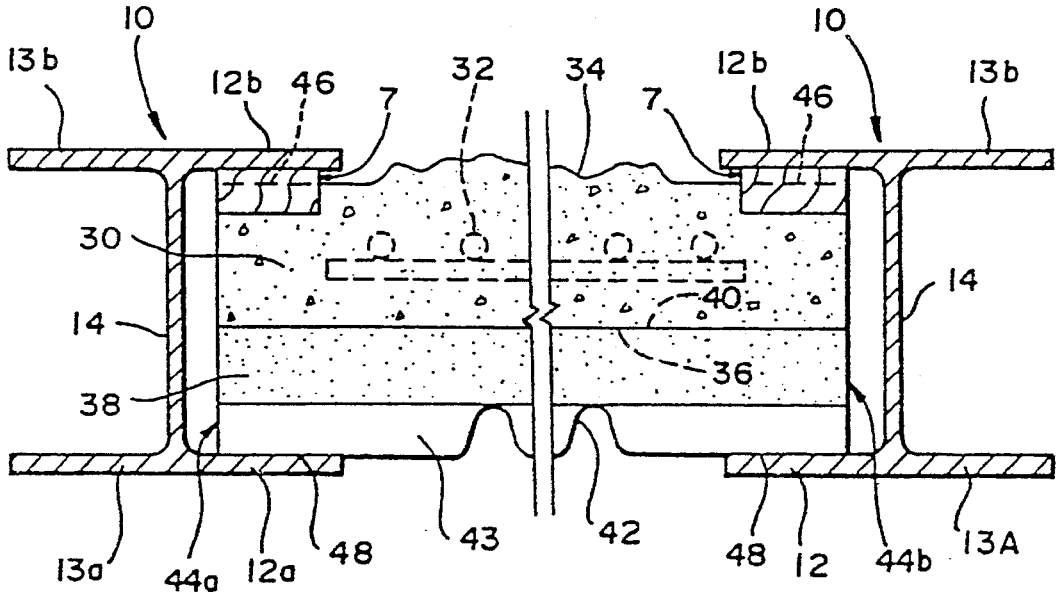
FIG. 2 is a plan view of the wall system illustrated in FIG. 1A along the line 2—2.
Figure 1B:
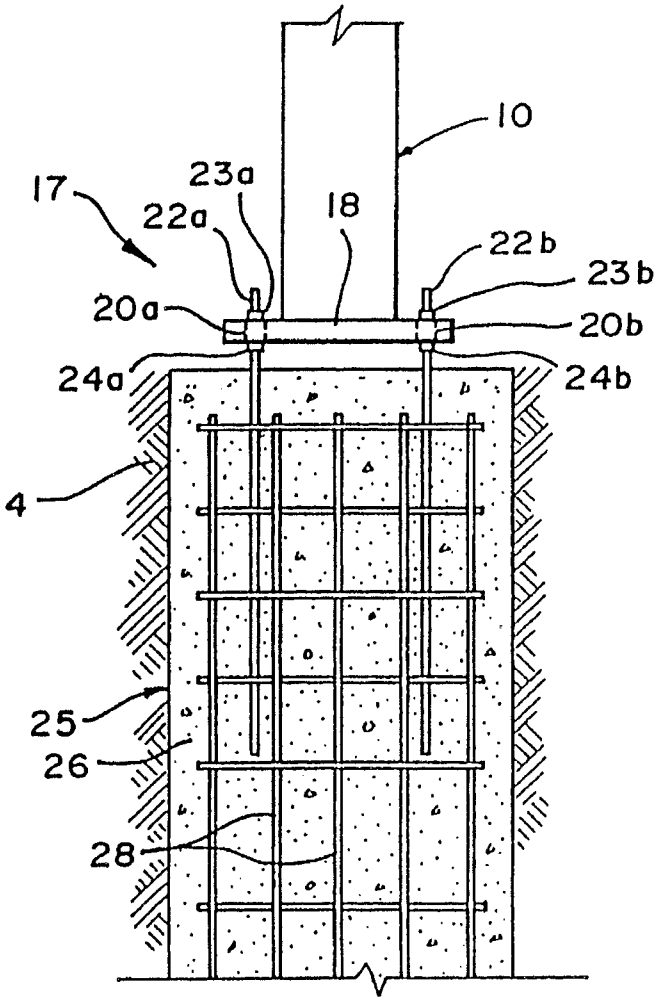
FIG. 1B is a cross-sectional side view of the base assembly circled in phantom in FIG. 1A.

With reference now to FIGS. 1A, 1B and 2, the acoustical wall system 1 of the invention generally comprises a plurality of post assemblies 3 vertically mounted in the ground 4, as well as a plurality of precast panels 5 which are stacked between the post assemblies 3 to a height 6 which is great enough to prevent unwanted noise from a highway from directly impinging a group of residences or other buildings (not shown). As will be discussed in more detail hereinafter, slack between side edges of the panels 5 and the space between the parallel flanges of the beams forming the post assemblies 3 is expeditiously taken out by a plurality of wedge members 7 which serve to snug the front faces of the panels 5 into acoustically obstructing engagement with the front flanges of the posts 3.

With specific reference now to FIG. 2, each of the post assemblies 3 is formed from an I-beam 10 having two pairs of opposing flanges 12*a,b* and 13*a,b* extending from a center web 14. The I-beam 10 may be galvanized steel, core 10 weathered steel or concrete. The top of the flanges of each of the beams 10 includes a taper 16 to facilitate the alignment of the side edges of the panels 5 within the flange pairs 12*a,b* and 13*a,b*. With specific reference now to FIG. 1B, the bottom ends of each of the beams 10 includes a base assembly 17. The base assembly 17 is formed from a square base plate 18 welded to the bottom of the beams 10, which includes four stud holes 20*a–d*, of which only holes 20*a* and 20*b* are shown. The holes 20*a–d* receive studs or anchor bolts 22*a–d*, and the base plate 18 is secured onto the studs by means of upper and lower nuts 23*a–d* and 24*a–d* as shown. The studs 22*a–d* extend down into and are secured within a pedestal 25 formed from a rectangular block of concrete 26 reinforced by a network 28 of steel bars. The use of studs and nuts to secure the bottom ends of the beams 10 onto the pedestal 25 not only allows the beams to be easily secured to and removed from the pedestals 25 incident to wall assembly and removal operations, but further provides a means for adjusting the vertical orientation of the beams 10 so that they are substantially plumb prior to the lowering of the wall panel 5 into the flange pairs 12*a,b* and 13*a,b*.

Figure 4:
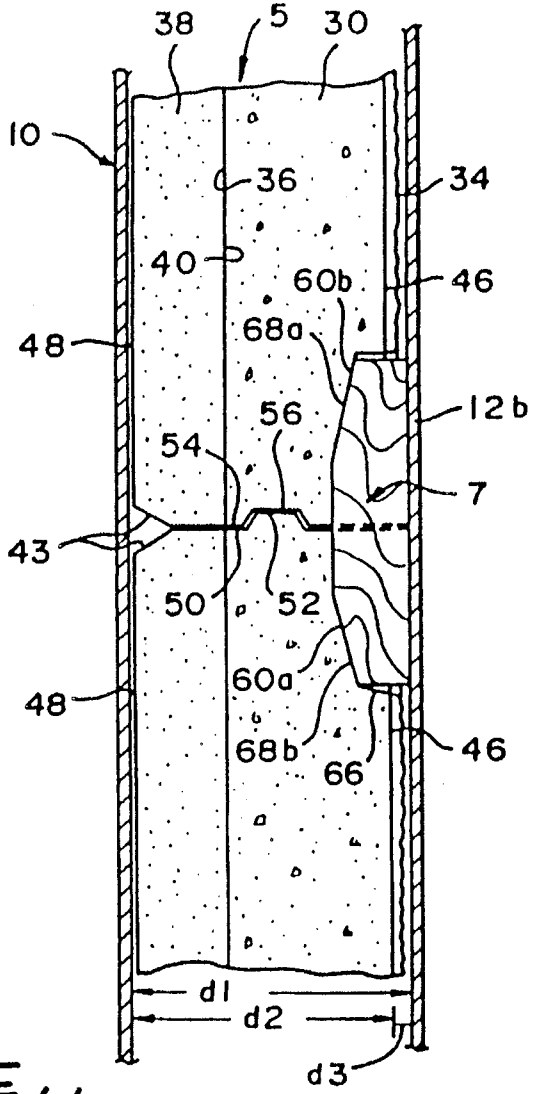
FIG. 4 is a side, cross-sectional view of the partial wall section illustrated in FIG. 3 along the line 4—4, illustrating how a single wedging member is received within adjacent, wedge-receiving recesses in different wall panels.
Figure 3:
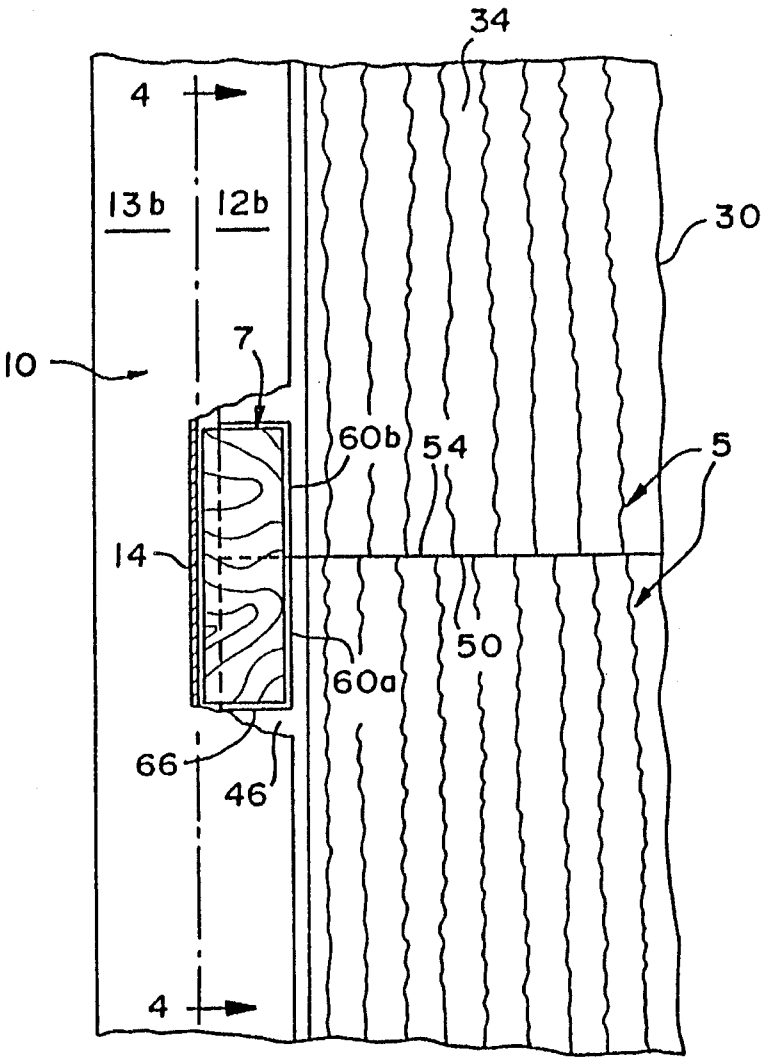
FIG. 3 is a partial back view of the wall system illustrated in FIG. 1A with part of the back flange of the post broken away so that the wedging member of the system may be more plainly seen.

With reference now to FIGS. 2, 3, and 4, each of the panels 5 of the wall system 1 includes a support layer 30 of precast concrete strengthened by a network of reinforcing steel 32. The back surface 34 may have a rough or rake finish, while the from surface 36 is substantially flat. In the preferred embodiment, the front surface 36 of the support layer 30 is covered by a layer 38 of sound absorbing material such as Durisol (available from The Reinforced Earth Company located in Vienna, Va.), or Soundtrap (available from Smith Midland Corporation located in Midland, Va.). Both materials are porous, compressible compositions formed in part by concrete having large amounts of air void spaces. The sound absorbing layer 38 includes a flat back surface 40 which overlies the flat front surface 36 of the support layer 30 as well as a fluted front surface 42 for absorbing sound. The front surface 42 of the sound absorbing layer 30 is circumscribed by a bevel 43 as shown. Each of the panels 5 includes a pair of opposing side edges 44*a,b* having a generally planar back side edge 46, and planar front side edge 48. The top edge 50 of each of the panels 5 includes a sound obstructing key 52 which fits into a keyway 56 located at the bottom edge 54 of another panel 5 when two panels are stacked together as shown in FIG. 4. In addition to sound obstruction, the interfitting key 52 and keyway 56 further help to rigidify the wall resulting from the assembly of the wall system 1.

Figure 5:
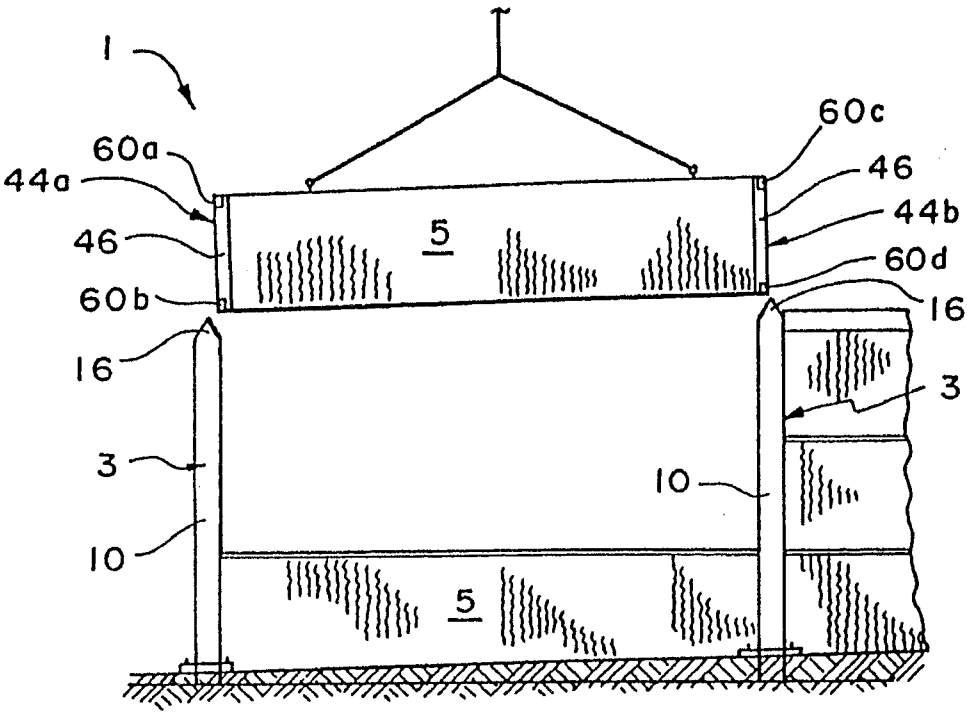
FIG. 5 is a back view of the wall system of the invention illustrating the method of assembly.

With reference now to FIGS. 3, 4, 5, and 6, both the top and bottom ends of each of the planar back side edges 46 of every panel 5 includes recesses 60*a,b* whose general locations are best seen with respect to FIG. 5. Each of the recesses 60*a,b* includes a flat upper section 62 bordered by a tapered wall 64 which are generally complementary to the lower half of a wedging member 7. The recesses 60*a* located on the upper ends of the planar back side edges 46 terminate in a bottom wall 66 which is slightly inclined relative to the horizontal so as to allow rain water which could otherwise soak the wooden wedge 7 and collect and freeze and break the panel 5 to drain out of the recess 60A.

As best seen in FIGS. 4 and 5, each of the wedging members 7 includes upper and lower tapered wedging surfaces 68*a,b* which are complementary in shape to the tapered walls 64 of upper and lower recesses 60*a,b*. The front portion of each of the wedging members 7 further includes a flat surface 69 which is approximately twice as long as the flat section 62 of either of the upper or lower recesses 60*a,b*. Finally, the back of the wedging member 7 includes a spacer portion generally indicated at 70 which is dimensioned to insure that when the wedging member 7 is inserted between the back flange 12B of a beam 10 and two mutually registering upper and lower recesses 60*a,b* of two different panels, the member 7 will apply a force sufficient to snug the planar front side edges 48 of the panel 5 into acoustically obstructing engagement with front flange 12*a* of the beam 10. The wedging member 7 is preferably formed from a material with similar compressive properties as the material forming the front face of the panel 5. Hence, when a layer of relatively soft and brittle sound absorbing material 38 is applied over the front of the panel 5, the wedging member 7 is preferably formed from a soft and yielding wood, such as pine. Alternatively, if the front face of the panels 5 is formed from a relatively hard, sound reflective material such as smoothly finished concrete (as would be the case if the wall system 1 were used to erect a sound reflective wall) the wedging member 7 is preferably formed from a hardwood such as oak or maple. In all cases where wood is used to form the wedging member 7, the wood is preferably pressure treated with aluminum salts to increase the members resistance to insects or fungi. In all instances, the spacer portion 70 of the wedging member 7 is dimensioned to provide a snug engagement between the front side edges 46 of the panels 5 and the front flanges 12*a* of the beams 10 forming the post assemblies 3. Specifically, as is shown in FIG. 4, if the distance between flanges 12*a,b* is d1, and the distances between the front and back side edges 46 and 48 of the panel is d2, then the spacer portion 70 of the wedging member 7 will be dimensioned so that it is slightly larger than d3, the difference between d1 and d2.

The method or operation of the invention is best understood with reference to FIGS. 5, 6, and 7. In the first step of the method of the invention, the pedestals 25 of the base assembly 17 of each of the post assemblies 3 are constructed by first auguring an appropriately dimensioned hole in the earth 4, and then casting the previously described steel-reinforced, cylindrical block of concrete 26 with the studs 22 extending slightly above the ground. Next, the beams 10 of the post assemblies 3 are secured onto the pedestals 25 by means of the previously described upper and lower nuts 23*a–d* and 24*a–d*. During this step, each of the beams 10 is accurately vertically positioned until it is plumb with respect to the surrounding ground. The pedestals 25 are spaced apart such that when the beams 10 are plumbly installed, the distance between the center webs 14 of adjacent beams 10 is only slightly wider than the width of the panels 5.

In the next step of the method, the side edges 44*a,b* of a first panel are aligned between opposing parallel flanges 12*a,b* of two adjacent beams 10 and then slid down to the bottom of the beams 10 as shown by means of a crane (not shown). This step is facilitated by the tapered end 16 of the flanges present at the top ends of each of the two adjacent beams 10.

Next, the bottom portions of two wedging members 7 are inserted in the upper recesses 60*a* existing on either side of the top edge of the lower panel 5, as shown in FIGS. 6 and 7. Such insertion of each of the wedging members 7 has the effect of snuggling the front side edge of the panel 5 against the front flange 12*a* in the manner previously described, while at the same time securely capturing the lower half of the wedging member 7 between the tapered wall 64 of the recess 60*a* and the back surface of the back flange 12*b* (as is best seen in FIG. 4).

A second panel 5 is next raised above the upper ends of the beams 10 of the adjacent post assemblies 3, as is shown in FIG. 5. The side edges 44*a,b* are again aligned between the pairs of adjacent flanges 12*a,b* of the two adjacent beams 3 with the help of the previously described tapers 16, and a second panel 5 is slid on top of the first installed panel 5. Just before the bottom edge 54 of the second panel 5 engages the top edge 50 of the bottommost panel 5, the upper portion of the wedging member 7 is received by the bottom recess 60*b* of the topmost panel, which automatically creates a wedging action which in turn snugs the front side edge 48 of the topmost panel 5 into engagement with the back surface of the top flange 12*a* as is best seen in FIGS. 4 and 7. All of the aforementioned panel raising and lowering steps are repeated until the wall created by the wall system 1 is complete.

With reference now to FIGS. 8 and 9, the wall of the system 1 can be conveniently raised at another location in response to changing acoustical conditions which may happen if, for example, the highway that the wall is next to is widened. It would further be possible to raise the wall system at the same location so long as the load capacity of the existing pedestals 25 and studs or anchor bolts 22*a–d* would not be exceeded. To raise the wall, post extensions 71 may be connected over the top ends of the beams 10 by splicing plates 73, which are secured to both the beam 10 and extension by means of welds 74. The extensions 71 may be formed from portions of steel beams which are identical in structure to the beams 10 initially erected, but the bottom beam may be larger in section if required to meet the structural requirement need for the additional height. Additional panels 75 may then be stacked over the former topmost panel 5 in the same manner as previously described.

To remove the wall created by the system 1, all of the aforementioned method steps are repeated in reverse. The resulting plurality of beams 10, wedging members 7, and panels 5 can then be conveniently reused to build another wall at another location.

With reference now to FIGS. 10, 11, and 12, the wall system 1 of the invention is not confined to the use of precast panels 5, but may also be used in conjunction with lightweight reflective acoustical wall panel assemblies 80 formed from a plurality of interconnected panel members 82 that may be easily installed on the tops of parapets 109 or traffic barriers. Such panel members 82 are extruded from a fiber reinforced, polymeric material with a tongue portion 84 along their top edges, and a groove portion 86 along their bottom edges. These tongue and groove portions 84, 86 allow the plank-like panel members 82 to be stacked in interfitting relationship as is illustrated in FIGS. 10 and 11. To secure these panel members 82 into a single panel assembly 80, U-shaped channel members 88 (which also may be formed from a fiber reinforced polymeric material) are provided which capture the end portions 90 of the stacked members 82 as shown. The channel members 88 are fastened to each of the panel members 82 by means of rivets (not shown). In order to add compressive strength to the end portions 90 of the panel members 82, each of the panel members 82 (which is hollow) is preferably filled with a resilient filling material 92 at its end portions 90 (as may best be seen in FIG. 16). In the preferred embodiment, the resilient filling material 92 is ground out automobile tires, and the panel members 82 are Carsonite® panels made from fiberglass available from Carsonite International, located in Carson City, Nev.

With reference now to FIGS. 13, 14, and 15, such panel assemblies 80 also include recesses 94 which interfit with wedging members 95 to press the back side edges of each panel assembly 80 into sound-right engagement with the flange 111 of a spacing angle 110. However, unlike the wedge-receiving recesses 60*a,b* associated with the precast panels 5, the recesses 94 formed between adjacent panel assemblies 80 are formed from the contours associated with the tongue portion 84 located on the upper edge of each panel assembly 80, and the groove portion 86 located along the bottom edge of each such panel assembly 80. As may best be seen with respect to FIG. 15, a recess 94 is formed at the interface of these tongue-and-groove portions largely as a result of the tapering of the upper edge of the tongue portion 84 of the topmost panel member 82. As is best seen in FIGS. 15 and 17*a*–17*c*, the wedging member 95 used in combination with the panel assemblies 80 has a contour which is complementary to the naturally occurring recess 94 created by the tapered tongue portion 84 and interfitting groove portion 86 between adjacent panel assemblies 80. Specifically, each wedge member 95 includes an upper inclined portion 97 (which may be used to form an upper half wedge 98), a lower inclined portion 99 (which may be used to form a lower half wedge 100), and a recess fitting portion 101 which is complementary in shape to the recess 94 in the vicinity of the tongue portion 84.

The operation or method of a wall system utilizing such panel assemblies 80 may best be understood with respect to FIGS. 13 and 16. Prior to installing any of the panel assemblies 80 between a pair of adjacent posts 3, a spacing angle 110 is welded or bolted onto the web 14 of the post 3 in the position illustrated in FIG. 16 in order to compensate for the much thinner thickness of such panel assemblies 80 relative to the thickness of precast panels 5. Next, upper half wedging members 98 are placed against the first flanges 13*b*, and on the base plates of the posts 3 in the position illustrated in FIG. 13. The lowermost panel assembly 80 is then lowered into the position illustrated in FIGS. 13 and 14. The interaction between the weight of the panel assembly 80 and the inclined surface of the half wedging members 98 causes the back side edge of the panel assembly 80 to firmly engage against the flange 111 of the spacing angle 110. Full-sized wedging members 95 are next placed in the positions illustrated in FIG. 13 against the flanges 13*b* of the posts 3. The topmost panel assembly 80 is then slid on top of the bottommost panel assembly 80 in the position illustrated in FIG. 15. The weight of the topmost panel assembly 80 interacts with the inclined surfaces of the full-size wedging members 95 to snug the upper and lower back side edges of the stacked panel assemblies 80 against the flange 111. After the last panel assembly 80 has been stacked in place, lower half wedging members 100 are forcefully inserted in the recesses 94 between the upper side edges of the topmost panel assembly 80 and the front flanges 13*b* of the posts 3 to snug the topmost panel assembly 80 against the flange 111. Holding screws 104 are then used to secure the wedging members 95, 98, and 100 in place so that they will not move laterally from under the front flange 13*b* of the post 3.

Alternatively, a flange 104.5 (shown in phantom in FIG. 16) may be integrally molded or separately connected to one side of the wedging members 95, 98, and 100 to prevent lateral movement once they have been installed in the wall system.

FIGS. 18 and 19 illustrate still another embodiment of the system 1 of the invention wherein only a single, full-height precast panels 105 are used to form an acoustical wall. In this embodiment, both the lower and upper corners of the panel 105 include recesses 60*a,b* that are complementary in shape to upper half wedging members 107 and lower half wedging members 108, respectively. In operation, this particular embodiment of the invention is assembled in the same manner as previously described with respect to the system illustrated in FIGS. 10 through 17C, the only difference being that no full-sized wedging members are used. After the single precast panel 105 has been lowered over upper half wedging members 107, lower half wedging members 108 are forcefully pushed or hammered into the upper recesses 60*a* so as to snugly secure the front of the side edges of the panel 105 against the front flanges 13*a* of the posts 3. In this particular embodiment, the half wedge members 107 and 108 are preferably formed from pressure-treated wood.

FIGS. 20, 21, and 22 illustrate still another embodiment of the system 1 which utilizes full-height precast panels 105 that are not stacked on top of one another. However, reversed full-sized wedging members 112 are integrally molded into recesses 113 at each of the corners of the panel 105 as shown. The 180° reversal of the position of the wedging members 112 allows their lower inclined surface to provide a lead-in or guide surface that allows the panel 105 to be inserted in the space between the flanges 13*a* and 13*b* of the posts 3. The inclined surfaces further act to snug the front of the side edges of the precast panel 105 against the front flange 113*a* after the panel 105 has been lowered to a rest position between the post 3 such that both the upper and lower reversed, full-sized wedging members 112 engage the post flange 13*b*. This embodiment of the system of the invention has the advantage of reducing the assembly time of the completed acoustical wall.

Finally, FIGS. 23 and 24 illustrate an adjustable width wedge assembly 115 that also forms part of the invention. The wedge assembly 115 is comprised of a wedging member 117 having inclined surfaces as previously described, in combination with a plurality of extender members 119 (only one of which is shown) which function to incrementally increase the width of the wedging member 117. To this end, one of a plurality of extender members 119, each of which has a different width (as indicated in phantom in FIG. 24) is selected to be used in combination with the wedging member 117 to adjust the width of the resulting wedge assembly 115 to a desired dimension. A dovetail joint 121 formed from a dovetail 122 in the extender member 119 and a complementarily shaped recess 123 in the wedging member 117 is advantageously used to firmly secure the members 117 and 119 together into a integral assembly 115. Providing the recess portion 123 of the joint 121 in the wedging member 117 (as opposed to the dovetail 122) advantageously allows the wedging member 117 to be used without an extender member 119 if desired. While the wedge assembly 115 is illustrated as being formed from wood (which is preferably pressure treated), it should be noted that it may be formed from any one of the materials previously mentioned in this specification. Additionally, while a dovetail joint 121 is illustrated in FIGS. 23 and 24, any one of a number of different types of joint may be used to the same advantage. Finally, while only one extender member 119 is illustrated in FIG. 24, this invention contemplates the use of a plurality of different sized extender members 119, each of which may easily and conveniently connected to a wedging member 117, so that a wedge assembly 115 of a specifically desired width may be easily assembled.

While both the system and method of this invention has been described with respect to a preferred embodiment, a number of substitutions of equivalent components and variations of similar method steps will become evident to the person of ordinary skill in the construction arts. All such substitutions and variations and equivalents thereof are encompassed within the scope of this invention, which is limited only by the claims appended hereto.

We claim:

1. A rapidly erectable, removable, and raisable post and panel outdoor wall system, comprising:

at least one wall panel having opposing side edges;

first and second spaced apart, elongate panel support posts, each of which includes first and second opposing flanges that define a longitudinally extending slot for receiving one of said side edges of said wall panel, and at least one wedging means disposed between each side edge of said panel and said first flange and having inclined surfaces that face said first flange for wedgingly forcing the side edge against the second of said flanges of said pair by wedgingly engaging said first flange when said side edge of said wall panel is inserted into said longitudinally extending slot defined between said first and second opposing flanges, wherein each of said side edges of said panel includes a recess means that is complementary in shape to said wedging means for receiving, securing and maintaining said wedging means at a selected location on said side edge when the side edges of said panel are slidably inserted into the longitudinally extended slots defined by said first and second flanges.

2. The outdoor wall system of claim 1, wherein said wedging means is integrally molded within said recess means.

3. The outdoor wall system of claim 1, wherein said recess means is formed from a reduced thickness portion of said side edge of said wall panel.

4. The outdoor wall system of claim 1, wherein said wall panel includes a sound obstructing material, and said wedging means wedgingly forces its respective side edge against said second flange in acoustically obstructing engagement.

5. The outdoor wall system of claim 4, wherein the second flange of each of said support posts includes a spacing angle mounted within the post.

6. The outdoor wall system of claim 1, wherein the wall formed by said wall system comprises only a single wall panel between said panel support posts.

7. The outdoor wall system of claim 3, wherein said wall panel includes an assembly of panel members having joint portions along upper and lower edges thereof, and wherein said reduced thickness portion is formed by the joint portions of adjacent panel members along side edges of said assembly.

8. The outdoor wall system of claim 1, wherein said wedging means includes a wedging member and an extender member for adjusting the width of the wedging means.

9. The outdoor wall system of claim 1, wherein said at least one wall panel includes first and second wall panels that are stackable over one another when the opposing side edges of each are inserted in said longitudinally extending slots in said support posts defined by said first and second opposing flanges.

10. The outdoor wall system of claim 9, wherein the recess means of said first panel receives a portion of said wedging means, and the recess means of said second panel receives a second portion of said wedging means when said second panel is stacked over said first panel such that said wedging means forces the side edges of the panels against the second flanges of said support posts.

11. The outdoor wall system of claim 1, wherein said wedging means is formed from a wood-polymer composite.

12. A rapidly erectable, removable, and raisable post and panel outdoor wall system, comprising:

first and second spaced apart, elongate panel support posts, each of which includes first and second opposing flanges that define a longitudinally extending slot;

at least two wall panels having opposing side edges insertable in stacked relation between the longitudinally extending slots in said posts that are defined by said post flanges, each wall panel including an assembly of panel members, the uppermost and lowermost panel members having joint portions for forming a joint as well as a recess along adjoining side edges when one of said panels is stacked over the other, said recess being formed from a reduced thickness portion in said lowermost panel member;

a wedging means disposed in said recess along said adjoining side edges for wedgingly forcing said panel side edges against the second of said flanges of said posts, and means for preventing said wedging means from sliding out of said recess in a lateral direction that is orthogonal to said longitudinally extending slot.

13. The outdoor wall system defined in claim 12, wherein said preventing means includes means for attaching said wedging means to said first of said flanges of said posts.

14. The outdoor wall system as defined in claim 13, wherein said means for attaching includes at least one bolt.

15. The outdoor wall system as defined in claim 12, wherein said preventing means includes a flange connected to said wedging means that engages a side end of one of said panel members.

16. A post and panel outdoor wall system wherein side edges of wall panels are slid between opposing flanges in panel support posts to form a wall, comprising:

a wedging member having a width and having inclined surfaces for generating compressive forces and a plurality of extender members for adjusting the width of the wedging member so that the inclined surfaces of the wedging member apply sufficient compressive forces between a back surface of said panel side edge and a first flange of a post to engage a front surface of said side edge against a second flange of a post.

17. The wall system of claim 16, further comprising a joint means for joining said wedging member to said extender members.

18. The wall system of claim 17, wherein said joint means includes a dovetail joint between said wedging member and said extender members.

19. The wall system of claim 17, wherein different ones of said plurality of said extender members adjusts the width of said wedging member to different values when joined thereon.

20. The wall system of claim 17, wherein more than one extender member may be joined to said wedging member to adjust the width thereof.

21. A rapidly erectable, removable, and raisable post and panel outdoor wall system, comprising:

at least one wall panel having opposing side edges;

first and second spaced apart, elongate panel support posts, each of which includes first and second opposing flanges that define a longitudinally extending slot for receiving one of said side edges of said wall panel, and at least one wedging means disposed between each side edge of said panel and said first flange for wedgingly forcing the side edge against the second of said flanges wherein said wedging means includes a wedging member and an extender member for adjusting the width of the wedging means, and wherein each of said side edges of said panel includes a recess means for receiving and securing said wedging means at a selected location on said edge.

22. The outdoor wall system of claim 21, wherein each of said wedging member and extender member includes a joint means for interconnecting said members.

23. The outdoor wall system of claim 22, wherein said joint means is a dovetail joint.

24. A rapidly erectable, removable, and raisable post and panel outdoor wall system, comprising:

at least one wall panel including a sound obstructing material and having opposing side edges;

first and second spaced apart, elongate panel support posts, each of which includes first and second opposing flanges that define a longitudinally extending slot for receiving one of said side edges of said wall panel, the second flange of each of said support posts including a spacing angle mounted within the post, and at least one wedging means disposed between each side edge of said panel and said first flange for wedgingly forcing the side edge against the second of said flanges in acoustically obstructing engagement, wherein each of said side edges of said panel includes a recess means for receiving and securing said wedging means at a selected location on said edge.

25. A rapidly erectable, removable, and raisable post and panel outdoor wall system, comprising:

at least one wall panel having opposing side edges;

first and second spaced apart, elongate panel support posts, each of which includes first and second opposing flanges that define a longitudinally extending slot for receiving one of said side edges of said wall panel, and at least one wedging means disposed between each side edge of said panel and said first flange for wedgingly forcing the side edge against the second of said flanges, said wedging means having at least one inclined surface for wedgingly engaging said first flange when said side edge of said panel is inserted into said longitudinally extending slot defined between said first and second opposing flanges, wherein each of said side edges of said panel includes a recess means for receiving and securing said wedging means at a selected location on said edge.

26. The outdoor wall system as defined in claim 25, wherein each panel includes a support layer of a castable material that hardens into a brittle solid, and a sound absorbing layer that is porous and compressive.

27. The outdoor wall system as defined in claim 26, wherein a top edge of each support layer has a key and a bottom edge of each support layer has a keyway to receive the key of a panel.

28. The outdoor wall system as defined in claim 25, wherein the flanges of each of said support posts includes tapered end portions for facilitating the insertion of said wall panel in said slot defined between said first and second flanges.

29. The outdoor wall system as defined in claim 25, wherein each of said support posts includes a base plate including holes for receiving studs mounted in a support pedestal.

30. The outdoor wall system as defined in claim 26, wherein said wedging means is formed from a material having similar compressive properties as said compressive sound absorbing layer.

* * * * *